US010077485B2

(12) United States Patent
Kobayashi et al.

(10) Patent No.: US 10,077,485 B2
(45) Date of Patent: Sep. 18, 2018

(54) STEEL SHEET FOR SOFT-NITRIDING AND METHOD FOR MANUFACTURING THE SAME

(75) Inventors: Takashi Kobayashi, Kawasaki (JP); Nobuyuki Nakamura, Fukuyama (JP); Yoshimasa Funakawa, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 252 days.

(21) Appl. No.: 14/409,549

(22) PCT Filed: Jun. 27, 2012

(86) PCT No.: PCT/JP2012/067025
§ 371 (c)(1),
(2), (4) Date: Jun. 15, 2015

(87) PCT Pub. No.: WO2014/002288
PCT Pub. Date: Mar. 1, 2014

(65) Prior Publication Data
US 2015/0354034 A1 Dec. 10, 2015

(51) Int. Cl.

| | |
|---|---|
| ***C22C 38/26*** | (2006.01) |
| ***C21D 6/00*** | (2006.01) |
| ***C22C 38/00*** | (2006.01) |
| ***C22C 38/06*** | (2006.01) |
| ***C22C 38/04*** | (2006.01) |
| ***C21D 9/46*** | (2006.01) |
| ***C21D 8/02*** | (2006.01) |
| ***C22C 38/02*** | (2006.01) |
| ***C22C 38/24*** | (2006.01) |
| ***C22C 38/38*** | (2006.01) |
| ***C23C 8/26*** | (2006.01) |

(52) U.S. Cl.
CPC ..... *C21D 9/46* (2013.01); *C21D 6/002* (2013.01); *C21D 6/005* (2013.01); *C21D 6/008* (2013.01); *C21D 8/0226* (2013.01); *C21D 8/0263* (2013.01); *C22C 38/00* (2013.01); *C22C 38/001* (2013.01); *C22C 38/02* (2013.01); *C22C 38/04* (2013.01); *C22C 38/06* (2013.01); *C22C 38/24* (2013.01); *C22C 38/26* (2013.01); *C22C 38/38* (2013.01); *C23C 8/26* (2013.01); *C21D 2211/005* (2013.01); *C21D 2211/009* (2013.01)

(58) Field of Classification Search
CPC ..... C21D 2211/005; C21D 2211/009; C21D 6/002; C21D 6/005; C21D 6/008; C21D 8/0226; C21D 8/0263; C21D 9/46; C22C 38/00; C22C 38/001; C22C 38/02; C22C 38/04; C22C 38/06; C22C 38/24; C22C 38/26
See application file for complete search history.

(56) References Cited

U.S. PATENT DOCUMENTS

| | | | | |
|---|---|---|---|---|
| 4,572,748 | A * | 2/1986 | Suga | C22C 38/44 148/500 |
| 2007/0144620 | A1 | 6/2007 | Soshiroda | |
| 2010/0196189 | A1* | 8/2010 | Nakagawa | C21D 8/0426 420/114 |
| 2013/0032253 | A1 | 2/2013 | Kariya et al. | |
| 2013/0133790 | A1* | 5/2013 | Ariga | C21D 8/0226 148/602 |

FOREIGN PATENT DOCUMENTS

| | | | | |
|---|---|---|---|---|
| CN | 1990895 | | 7/2007 | |
| CN | 1990895 | A * | 7/2007 | C21D 6/008 |
| EP | 1205570 | | 5/2002 | |
| JP | 59067365 | | 4/1984 | |
| JP | 4154936 | | 5/1992 | |
| JP | 5171347 | | 7/1993 | |
| JP | 09025513 | | 1/1997 | |
| JP | 09025543 | | 1/1997 | |
| JP | H09143570 | A | 6/1997 | |
| JP | 09279296 | | 10/1997 | |
| JP | 10265846 | | 10/1998 | |
| JP | 10265846 | A * | 10/1998 | |
| JP | 10306343 | | 11/1998 | |
| JP | 2001316759 | | 11/2001 | |
| JP | 2002069572 | | 3/2002 | |
| JP | 2003105489 | | 4/2003 | |
| JP | 2003277887 | | 10/2003 | |
| JP | 2004256831 | | 9/2004 | |
| JP | 2005171331 | | 6/2005 | |
| JP | 2005264205 | | 9/2005 | |

(Continued)

OTHER PUBLICATIONS

Chinese Office Action for Chinese Application No. 201280074343.1, dated Aug. 23, 2016, including Concise Statement of Relevance, 12 pages.
Extended European Search Report dated Feb. 8, 2016 for European Application No. 12879635.6-1373.
International International Application No. PCT/JP2012/067025 dated Sep. 4, 2012.
Korean Office Action dated Mar. 29, 2016 for Korean Application No. 2015-7000899, including Concise Statement of Relevance.
Chinese Office Action with partial English language translation for Application No. 201280074343.1, dated Mar. 14, 2017, 8 pages.
Manyun Li, Technical manual of controlled rolling and controlled cooling of steel (p. 82), Metallurgical Industry Press, Sep. 1990, 4 pages.

(Continued)

*Primary Examiner* — Jenny R Wu
(74) *Attorney, Agent, or Firm* — RatnerPrestia

(57) ABSTRACT

A steel sheet for soft-nitriding has a composition containing: C: 0.05% or more to 0.10% or less; Si: 0.5% or less; Mn: 0.7% or more to 1.5% or less; P: 0.05% or less; S: 0.01% or less; Al: 0.01% or more to 0.06% or less; Cr: 0.5% or more to 1.5% or less; V: 0.03% or more to 0.30% or less; and N: 0.005% or less, on a mass percent basis, wherein a ratio of amount of solute V to the V content (amount of solute V/V content) is more than 0.50, and balance comprises Fe and incidental impurities, and a complex-phase microstructure containing ferrite and pearlite.

4 Claims, No Drawings

(56) References Cited

FOREIGN PATENT DOCUMENTS

| | | |
|---|---|---|
| JP | 2007031771 | 2/2007 |
| JP | 2008280598 | 11/2008 |
| JP | 2009068057 | 4/2009 |
| WO | 2011132763 A1 | 10/2011 |

OTHER PUBLICATIONS

Qingyu Wong, Ultra-Fine Grained Steels-Microstructure refinement theory and control technology of steel (p. 385), Metallurgical Industry Press, Sep. 2003, 2 pages.
Chinese Office Action for Chinese Application No. 201280074343.1, dated Nov. 6, 2017, including Concise Statement of Relevance of Office Action, 6 pages.
Final Office Action for U.S. Appl. No. 14/781,440, dated Apr. 24, 2018, 14 pages.
U.S. Non-Final Office Action for U.S. Appl. No. 14/781,440, dated Oct. 18, 2017, 18 pages.

* cited by examiner

STEEL SHEET FOR SOFT-NITRIDING AND METHOD FOR MANUFACTURING THE SAME

CROSS REFERENCE TO RELATED APPLICATIONS

This is the U.S. National Phase application of PCT/JP2012/067025, filed Jun. 27, 2012, the disclosure of this application being incorporated herein by reference in its entirety for all purposes.

FIELD OF THE INVENTION

The present invention relates to a steel sheet for soft-nitriding (nitrocarburizing) suitable for mechanical structure components including transmission components for automobile and the like, where fatigue strength and wear resistance are required. In particular, the present invention relates to a steel sheet for soft-nitriding and a method for manufacturing the steel sheet for soft-nitriding excellent in formability before soft-nitriding and excellent in a fatigue resistance property after the soft-nitriding.

BACKGROUND OF THE INVENTION

For mechanical structure components including transmission components for automobile and the like, which are used under stress continuously for a long time, fatigue strength and wear resistance are required. Accordingly, these mechanical structure components are usually manufactured by processing a steel material to a desired component shape followed by surface hardening heat treatment. Performing the surface hardening heat treatment hardens a steel surface and introduces compressive residual stress to a steel surface layer portion, improving the fatigue strength and the wear resistance.

Carburizing and nitriding are shown as the typical surface hardening heat treatment. The carburizing heats a steel to a temperature of an $A_3$ transformation point or more so that carbon diffuses and penetrates (carburize) at the surface layer portion of the steel. Usually, a high-temperature steel after carburizing is directly quenched to achieve surface hardening of the steel. In this carburizing, since the carbon is diffused and penetrated at the steel surface layer portion in a high-temperature range of the $A_3$ transformation point or more, the carbon diffuses and penetrates from the steel surface to a comparatively deep position. This allows obtaining a large surface hardened layer depth.

However, in the case where the carburizing is employed as the surface hardening heat treatment, deterioration in accuracy of component shape caused by transformation strain and heat strain during the quenching cannot be avoided. In a state where the steel remains to be as-quenched after the carburizing, toughness of the steel is considerably deteriorated. Accordingly, when manufacturing components through the carburizing, to achieve correction of a component shape and recovery of toughness, performing tempering (for example, press tempering treatment) is necessary after the quenching. This increases the number of manufacturing steps, extremely disadvantageous in terms of a production cost.

On the other hand, the nitriding heats a steel to a temperature of an $A_1$ transformation point or less to diffuse and penetrate (nitride) nitrogen at the steel surface layer portion. This ensures surface hardening of the steel without quenching like the carburizing. That is, since the nitriding features a comparatively low treatment temperature and does not involve a phase transformation of the steel, manufacturing the components through the nitriding allows maintaining good accuracy of component shape. However, gas nitriding using ammonia gas requires considerably long nitriding time, approximately 25 to 150 hours, and therefore is not suitable to automotive parts and the like supposed to be mass produced.

Soft-nitriding has been recently popular as treatment for advantageously solving the problem observed in the gas nitriding. The soft-nitriding is nitriding to quickly progress a nitriding reaction using carburizing atmosphere. An object to be processed is held in treatment atmosphere at 550 to 600° C. for several hours. Through generation of iron carbide, nitrogen is diffused and introduced from the steel surface to the inside of the steel. Although obtained steel surface hardness is lower than the conventional nitriding (gas nitriding), this soft-nitriding allows significant shortening of the nitriding time.

The soft-nitriding is broadly classified into a method of treatment in salt bath and a method of treatment in gas. The method of treatment in salt bath (salt bath soft-nitriding) uses a cyanogen-based bath; therefore, measures to prevent environmental pollution is necessary. On the other hand, since the method of treatment in gas (gas soft-nitriding) uses mixed gas with the main component of ammonia, this method emits less discharge causing the environmental pollution. Due to the above-described reasons, an adoption ratio of the gas soft-nitriding, which treats a steel in gas, has been particularly increased among the soft-nitriding.

On the other hand, conventionally, mechanical structure components such as transmission components for automobile are generally manufactured by machining an intermediate product obtained by casting and forging and then processing and joining the intermediate product to a desired shape. However, recently, steel sheets (thin steel sheets) have been actively used as a raw material. Performing press processing or the like on the steel sheet (thin steel sheet) shapes the steel sheet into a desired shape, thus manufacturing the component. This shortens the manufacturing processes than the conventional manufacturing processes, allowing significant reduction of the production cost. From this background, demands on the steel sheet for soft-nitriding excellent in formability, which is suitable as a material of the mechanical structure component including the transmission component for automobile or the like, have been increased, and accordingly, various techniques have been proposed up to the present.

For example, Patent Literature 1 and Patent Literature 2 disclose a method for manufacturing steel sheet for nitriding excellent in formability and the steel sheet for nitriding excellent in formability having a composition described below. A steel has a chemical composition containing, by weight ratio, C: 0.01 to less than 0.08%, Si: 0.005 to 1.00%, Mn: 0.010 to 3.00%, P: 0.001 to 0.150%, N: 0.0002 to 0.0100%, Cr: more than 0.15 to 5.00%, Al: more than 0.060 to 2.00%, and further containing one or two of Ti: 0.010% or more to less than 4C[%], and V: 0.010 to 1.00%. The steel is coiled at 500° C. or more after hot rolling, or is further cold-rolled at a rolling reduction of 50% or more after the coiling followed by recrystallization annealing. According to this technique, by controlling a C content, which adversely affects the formability, to less than 0.08% and by containing Cr, Al, or the like as a nitriding promoting element, it is described that steel sheet for nitriding excellent in formability and nitridation is obtained.

Patent Literature 3 proposes the following steel for soft-nitriding. The steel for soft-nitriding has a chemical composition containing, by mass %: C: 0.03% or more to less than 0.10%, Si: 0.005 to 0.10%, Mn: 0.1 to 1.0%, and Cr: 0.20 to 2.00% and as impurities, S: 0.01% or less, P: 0.020% or less, sol. Al: 0.10% or less, and N : 0.01% or less and the balance comprising Fe. The steel for soft-nitriding has a ferrite grain size of grain size number 5 or more to 12 or less specified by JIS G 0552. According to the technique, it is descried that since expensive element of Ti, V, or the like is not added, an inexpensive steel sheet can be obtained. Moreover, it is descried that refining a crystal grain diameter of the steel allows obtaining a steel sheet excellent in press processability.

Patent Literature 4 proposes the following thin steel sheet for nitriding. The thin steel sheet for nitriding has a chemical composition containing, by mass %: C: more than 0.01% to 0.09% or less, Si: 0.005 to 0.5%, Mn: 0.01 to 3.0%, Al: 0.005 to 2.0%, Cr: 0.50 to 4.0%, P: 0.10% or less, S: 0.01% or less, and N: 0.010% or less. Optionally, the thin steel sheet for nitriding further contains one or two or more selected from V: 0.01 to 1.0%, Ti: 0.01 to 1.0%, and Nb: 0.01 to 1.0%. A grain boundary area Sv per unit volume is set at 80 $mm^{-1}$ or more to 1300 $mm^{-1}$ or less. According to the technique, by containing a nitride forming element, Cr, Al, V, Ti, Nb, or the like in a range of not inhibiting the formability of the steel sheet as well as regulating the grain boundary area per unit volume in a predetermined range, it is described that both high surface hardness and sufficient hardening depth can be obtained after nitriding.

Patent Literature 5 proposes a steel sheet for soft-nitriding containing: C: 0.01 to 0.10 mass %, Si: 0.1 mass % or less, Mn: 0.1 to 1.0 mass %, P: 0.05 mass % or less, S: 0.01 mass % or less, Al: 0.01 to 0.06 mass %, Cr: 0.05 to 0.50 mass %, V: 0.01 to 0.30 mass %, and N: 0.01 mass % or less and the balance comprising Fe and incidental impurities. It is described that according to the technique, the steel sheet for soft-nitriding contains Cr: 0.05 to 0.50 mass % and V: 0.01 to 0.30 mass % as nitriding promoting elements, and this improves surface hardening characteristics by soft-nitriding . It is described, accordingly, the inexpensive soft-nitriding steel sheet excellent in formability before soft-nitriding and also excellent in surface hardening characteristics after the soft-nitriding can be manufactured without adding a large amount of alloying elements.

Patent Literature 6 proposes a steel sheet for soft-nitriding containing: C: 0.04 to 0.08 mass %, Si: 0.1 mass % or less, Mn: 0.05 to 0.6 mass %, P: 0.03 mass % or less, S: 0.01 mass % or less, Al: 0.1 mass % or less, Cr: 0.6 to 1.2 mass %, V: 0.002 to less than 0.01 mass %, and N: 0.01 mass % or less and the balance comprising Fe and incidental impurities. According to the technique, it is described that containing an infinitesimal quantity of V (0.002 to less than 0.01 mass %) allows forming a nitrided layer featuring high hardness and less formation of porous layers by the soft-nitriding. It is described that, thus, the steel sheet for soft-nitriding with excellent processability and also excellent wear resistance can be obtained.

Patent Literature 1: Japanese Unexamined Patent Application Publication No. 9-25513

Patent Literature 2: Japanese Unexamined Patent Application Publication No. 9-25543

Patent Literature 3: Japanese Unexamined Patent Application Publication No. 2003-105489

Patent Literature 4: Japanese Unexamined Patent Application Publication No. 2003-277887

Patent Literature 5: Japanese Unexamined Patent Application Publication No. 2005-171331

Patent Literature 6: Japanese Unexamined Patent Application Publication No. 2008-280598

SUMMARY OF THE INVENTION

However, the techniques proposed in Patent Literature 1 and Patent Literature 2 contain a large amount of Al as the nitriding promoting element. Therefore, an internal defect and a surface defect caused by an Al inclusion are apprehended. Since a considerable amount of Al based slug is generated during refining, a problem of rising smelting cost is also observed.

The technique proposed in Patent Literature 3 does not contain expensive elements, allowing obtaining inexpensive steel sheet for soft-nitriding. However, strength (tensile strength) of the steel sheet for soft-nitriding is around 420 MPa at the highest. This restricts an application to components used under high stress.

The technique proposed in Patent Literature 4 succeeds obtaining the thin steel sheet for nitriding with tensile strength exceeding 500 MPa; however, the technique does not consider hardness distribution in a sheet thickness direction after the nitriding. Therefore, with the technique, durability performance of components on which the nitriding is actually performed often fails to reach a necessary or sufficient level.

The technique proposed in Patent Literature 5 succeeds obtaining the steel sheet for soft-nitriding excellent in surface hardening characteristics by soft-nitriding; however, the tensile strength does not reach 390 MPa. Therefore, application to mechanical structure components to which high stress is loaded is difficult, resulting in poor versatility.

The technique proposed in Patent Literature 6 succeeds obtaining a steel sheet for soft-nitriding that forms a nitrided layer of good quality by containing an infinitesimal quantity of V (0.002 to less than 0.01 mass %) together with Cr (0.6 to 1.2 mass %) and features excellent wear resistance. However, the strength (tensile strength) of the steel sheet for soft-nitriding is around 400 MPa at the highest. Accordingly, similarly to the technique proposed in Patent Literature 3, this restricts an application to components used under high stress.

Further, when soft-nitriding the steel sheet, the steel sheet is usually heated to a treatment temperature of about 550 to 600° C. and then is held at the treatment temperature for about one to five hours. This considerably increases hardness of the steel sheet surface layer portion while the strength of the internal portion of sheet thickness (non-nitrided portion) of steel sheet may be deteriorated by soft-nitriding, though. Therefore, even if the steel sheet has a desired strength (tensile strength) before the soft-nitriding, the soft-nitriding possibly tremendously deteriorates the strength of the internal portion of sheet thickness (non-nitrided portion) of steel sheet, failing to provide desired strength and fatigue resistance property to end products after soft-nitriding.

Due to the above-described reasons, with the steel sheet for soft-nitriding, it is one of the important characteristics for the internal portion of sheet thickness (non-nitrided portion) of the steel sheet to have desired strength even after the soft-nitriding. However, the all above-described conventional techniques do not examine a change in the strength of the internal portion of sheet thickness observed before and after the soft-nitriding at all.

The present invention advantageously solves the problems with the conventional techniques described above, and an object of the present invention is to provide a steel sheet for soft-nitriding featuring desired strength (tensile strength: 440 MPa or more) and excellent fatigue resistance property after soft-nitriding; and a method for manufacturing the steel sheet for soft-nitriding.

Intensive research was carried out by the inventors of the present invention on various factors affecting strength and formability of a steel sheet for soft-nitriding and a change in strength of an internal portion of sheet thickness (non-nitrided portion) of steel sheet observed before and after the soft-nitriding in order to solve the above problems. As a result, the following findings were obtained.

1) Producing a steel sheet microstructure by a complex-phase microstructure that includes ferrite and pearlite allows reducing deterioration of strength of a steel sheet after soft-nitriding, ensuring obtaining the steel sheet featuring excellent strength stability.
2) Regarding a steel sheet composition, containing a desired amount of V and ensuring more than half of the V content as solute V allows increasing the strength of the internal portion of sheet thickness (non-nitrided portion) of the steel sheet as well as the surface layer portion of the steel sheet through the soft-nitriding, resulting in improving the fatigue resistance property.
3) After soft-nitriding, increasing the hardness of the internal portion of sheet thickness (non-nitrided portion) of the steel sheet by more than 5% than the hardness of the internal portion of sheet thickness before the soft-nitriding stably improves the fatigue resistance property.

The present invention was completed based on the above-described findings, and the following aspects are included in the present invention. (1) A steel sheet for soft-nitriding has a chemical composition containing: C: 0.05% or more to 0.10% or less; Si: 0.5% or less; Mn: 0.7% or more to 1.5% or less; P: 0.05% or less; S: 0.01% or less; Al: 0.01% or more to 0.06% or less; Cr: 0.5% or more to 1.5% or less; V: 0.03% or more to 0.30% or less; and N: 0.005% or less, on a mass percent basis, wherein a ratio of amount of solute V to the V content (amount of solute V/V content) is more than 0.50, and balance comprises Fe and incidental impurities, and a complex-phase microstructure containing ferrite and pearlite.

(2) According to (1), the chemical composition of the steel sheet for soft-nitriding further contains Nb of 0.005% or more to 0.025% or less by mass %.

(3) A method for manufacturing a steel sheet for soft-nitriding includes: heating a steel slab; performing hot rolling that includes rough rolling and finish rolling; and after the finish rolling, cooling and coiling the steel sheet to produce a hot-rolled steel sheet, wherein the steel slab has a chemical composition containing: C: 0.05% or more to 0.10% or less; Si: 0.5% or less; Mn: 0.7% or more to 1.5% or less; P: 0.05% or less; S: 0.01% or less; Al: 0.01% or more to 0.06% or less; Cr: 0.5% or more to 1.5% or less; V: 0.03% or more to 0.30% or less; and N: 0.005% or less, on a mass percent basis, wherein balance comprises Fe and incidental impurities, and setting a heating temperature of the hot rolling from 1100° C. or more to 1300° C. or less, setting a finishing temperature of the finish rolling from an $Ar_3$ transformation point or more to ($Ar_3$ transformation point +100° C.) or less, setting an average cooling rate of the cooling to 30° C./s or more, and setting a coiling temperature of the coiling from 500° C. or more to 600° C. or less.

(4) According to (3), the chemical composition of the steel sheet for soft-nitriding further contains Nb of 0.005% or more to 0.025% or less by massa.

The present invention can provide a steel sheet for soft-nitriding that has a desired strength (tensile strength: 440 MPa or more) and excellent formability before soft-nitriding and fatigue resistance property after the soft-nitriding. This steel sheet can also be used even for components used under high stress including transmission components for automobile and the like. This allows greatly reducing a production cost, providing industrially useful effects.

DETAILED DESCRIPTION OF EMBODIMENTS OF THE INVENTION

The present invention. will be described in detail with reference to exemplary embodiments. Firstly, reasons why the chemical compositions of a steel sheet according to the present invention are preferred will be described. Hereinafter, "%" used for the chemical composition indicates "mass %", unless otherwise stated.

C: 0.05% or more to 0.10% or less

C is an element that contributes to strengthening of steels through solid solution strengthening and formation of a second phase. If a C content is less than 0.05%, steel sheet strength required for a material of a component used under high stress including a transmission component for automobile and the like, cannot be ensured. Meanwhile, if the C content exceeds 0.10%, the steel sheet strength excessively increases, deteriorating formability. Accordingly, the C content is set to be 0.05% or more to 0.10% or less, preferably, 0.05% or more to 0.08% or less.

Si: 0.5% or less

Si is a solid-solution strengthening element. Si is an element effective for strengthening of the steel and also acts as a deoxidizer. To obtain this effect, containing Si of 0.03% or more is preferred. However, if the Si content exceeds 0.5%, a hard-to-remove scale is generated, remarkably deteriorating a surface appearance quality of the steel sheet. Accordingly, the Si content is set to be 0.5% or less, preferably, 0.1% or less.

Mn: 0.7% or more to 1.5% or less

Mn is a solid-solution strengthening element, and is an element effective for strengthening of the steel. Mn also fixes S present in a steel as impurities, as a precipitate, and acts as an element reducing a negative effect caused by S to the steel. If the Mn content is less than 0.7%, desired steel sheet strength cannot be ensured. Meanwhile, if the Mn content exceeds 1.5%, the steel sheet strength excessively increases, deteriorating formability. Accordingly, the Mn content is set to be 0.7% or more to 1.5% or less, preferably, 1.0% or more to 1.5% or less, more preferably, 1.2% or more to 1.5% or less.

P: 0.05% or less

P is an element that deteriorates the formability and toughness of the steel sheet, and is preferred to be reduced as much as possible in the present invention. Accordingly, the P content is set to be 0.05% or less, preferably, 0.03% or less.

S: 0.01% or less

S is an element that deteriorates the formability and toughness of the steel sheet similar to P, and is preferred to be reduced as much as possible in the present invention. Accordingly, the S content is set to be 0.01% or less, preferably, 0.005% or less.

Al: 0.01% or more to 0.06% or less

Al is an element acting as a deoxidizer. To reliably obtain this effect, the Al content is set to be 0.01% or more. Meanwhile, if the Al content exceeds 0.06%, an effect as deoxidizer is saturated and an Al-based inclusion is increased, causing an internal defect and a surface defect of the steel sheet. Accordingly, the Al content is set to be 0.01% or more to 0.06% or less, preferably, 0.02% or more to 0.05% or less.

Cr: 0.5% or more to 1.5% or less

Cr is an element that forms a nitride in a steel by soft-nitriding, and is an element that has an effect of enhancing hardness of the steel sheet surface layer portion. Therefore, Cr is an important element in the present invention. To make the effect remarkable, the Cr content is preferably 0.5% or more. Meanwhile, if the Cr content exceeds 1.5%, embrittlement of a surface hardened layer (nitrided layer) formed by the soft-nitriding becomes severe. Accordingly, the Cr content is set to be 0.5% or more to 1.5% or less, preferably, 0.5% or more to 1.0% or less.

V: 0.03% or more to 0.30% or less

V has an effect of forming a nitride in a steel by soft-nitriding and enhancing hardness of a steel sheet surface layer portion. V is an element also having an effect of enhancing strength of the internal portion of sheet thickness (non-nitrided portion) of the steel sheet through soft-nitriding. Therefore, V is the most important element in the present invention. V precipitated in a steel before soft-nitriding also has an effect of enhancing the strength of the steel sheet for soft-nitriding by particle dispersion strengthening (precipitation strengthening). The V content of less than 0.03% cannot sufficiently develop these effects. Meanwhile, the V content in excess of 0.30% makes embrittlement of the surface hardened layer (nitrided layer) formed by the soft-nitriding severe and becomes economically disadvantageous because of saturating an effect of improving strength of the steel sheet. Accordingly, the V content is set to be 0.03% or more to 0.30% or less, preferably, 0.05% or more to 0.20% or less.

N: 0.005% or less

N is a harmful element that deteriorates the formability of steel sheet. N is also an element that combines, before the soft-nitriding, with a nitriding promoting element including Cr or the like, and causes a reduction of an amount of effective nitriding promoting element. Accordingly, with the present invention, the N content is preferred to be reduced as much as possible and is set to be 0.005% or less, preferably, 0.003% or less.

Ratio of an amount of solute V to the V content (amount of solute V/V content): more than 0.50

The solute V in the steel sheet improves the strength of the surface layer portion and the internal portion of sheet thickness (non-nitrided portion) of the steel sheet through soft-nitriding; therefore, the solute V serves an important role to ensure the fatigue resistance property after the soft-nitriding. Therefore, in embodiments of the present invention, the ratio of the amount of solute V to the V content of the steel sheet for soft-nitriding, namely, the steel sheet before soft-nitriding, is set to be more than 0.50.

As described above, soft-nitriding the steel sheet may deteriorate the strength of the internal portion of sheet thickness (non-nitrided portion) of the steel sheet though thermal history during the soft-nitriding, possibly failing to obtain desired fatigue resistance property after the soft-nitriding. Accordingly, it is important for the steel sheet for soft-nitriding to have characteristics where the internal portion of sheet thickness (non-nitrided portion) of the steel sheet after performing soft-nitriding has desired strength.

As means for ensuring the strength of the internal portion of sheet thickness (non-nitrided portion) of the steel sheet after performing the soft-nitriding, means that sets the strength of the steel sheet for soft-nitriding high is also conceivable by considering the amount of strength of the internal portion of sheet thickness (non-nitrided portion) of the steel sheet deteriorated by the soft-nitriding. However, excessively enhancing the steel sheet strength deteriorates the formability of the steel sheet, and becomes disadvantage in shaping the steel sheet to a desired component shape before the soft-nitriding.

When mechanical structure components requiring fatigue strength and wear resistance are manufactured using the steel sheets for soft-nitriding as raw materials, the steel sheets for soft-nitriding are shaped into the desired component shape by press processing or the like and then soft-nitrided, thus producing the end products. Accordingly, enhancing the strength of the steel sheet for soft-nitriding (steel sheet before soft-nitriding) excessively is not preferred as the formability before the soft-nitriding is adversely affected.

On the other hand, if performing the soft-nitriding on the steel sheet for soft-nitriding allows increasing the strength of the internal portion of sheet thickness (non-nitrided portion). more than the strength of the internal portion of sheet thickness before the soft-nitriding, the fatigue resistance property after the soft-nitriding can be improved without deteriorating the formability before the soft-nitriding. Accordingly, as the steel sheet for soft-nitriding to which the fatigue resistance property after the soft-nitriding is required as well as the formability before the soft-nitriding, it is ideal for the steel sheet for soft-nitriding to have characteristics of increasing the strength of the internal portion of sheet thickness (non-nitrided portion) of the steel sheet through the soft-nitriding.

Through examinations on means to enhance the strength of the internal portion of sheet thickness (non-nitrided layer) of the steel sheet through the soft-nitriding by the inventors, it was perceived that containing a desired amount of solute V in the steel sheet before the soft-nitriding and precipitating the solute V as carbide during the soft-nitriding are effective.

Based on this finding, more than half of the V content is ideally the solute V, that is, the ratio of the amount of solute V to the V content (amount of solute. V/V content) is more than 0.50, while the V content in the steel sheet is 0.03% or more to 0.30% or less. If the ratio of the amount of solute V to the V content (amount of solute V/V content) is 0.50 or less, an effect of an increase in the strength of the internal portion of sheet thickness (non-nitrided portion) of the steel sheet accompanied by the soft-nitriding cannot be sufficiently developed. From the aspect of precipitating V as carbonitride (including carbide and nitride)into the steel before soft-nitriding, such that ensuring both the strength of steel sheet before the soft-nitriding and an amount of hardness by the soft-nitriding, it is preferred that the upper limit value of the ratio of the amount of solute V to the V content (amount of solute V/V content) be 0.80.

The compositions described above are basic compositions of the present invention; however, Nb can be additionally contained in addition to the basic compositions.

Nb: 0.005% or more to 0.025% or less

Nb is an effective element in terms of enhancing the strength of the steel sheet by performing the particle dispersion strengthening (precipitation strengthening) on Nb precipitated as carbonitride (including carbide and nitride) in steel and can be contained as necessary. If the Nb content is less than 0.005%, this effect cannot be sufficiently developed. Meanwhile, if the Nb content exceeds 0.025%, the steel sheet strength excessively increases, deteriorating the formability. Accordingly, the Nb content is set to be 0.005% or more to 0.025% or less, preferably, 0.010% or more to 0.020% or less.

In the steel sheet of the present invention, the components other than the components described above are Fe and incidental impurities. As incidental impurities, for example, by mass %, Cu: 0.05% or less, Ni: 0.05% or less, Mo: 0.05% or less, Co: 0.05% or less, Ti: 0.005% or less, Zr: 0.005% or less, Ca: 0.005% or less, Sn: 0.005% or less, O: 0.005% or less, B: 0.0005% or less, and the like are acceptable.

The following describes reasons for the preferred microstructure of the steel sheet of the present invention. The steel sheet of the present invention preferably has a microstructure which is a complex-phase microstructure that contains ferrite and pearlite.

Increasing the ratio of the ferrite occupying the steel sheet microstructure is effective to ensure the formability of steel sheet. However, if the steel sheet is produced into a ferrite single-phase microstructure, the steel strength becomes insufficient and an application range as a material of a mechanical structure component is narrowed, resulting in poor versatility. On the other hand, in the case where a second phase is generated in a microstructure mainly containing ferrite to ensure the steel sheet strength, if a hard low-temperature transformation phase formed of martensite, bainite, or the like is produced as a second phase, the thermal history during the soft-nitriding softens the low-temperature transformation phase. This significantly deteriorates the strength of the internal portion of sheet thickness (non-nitrided portion) of the steel sheet.

Therefore, with the present invention, to reduce the deterioration of the strength of the internal portion of sheet thickness (non-nitrided portion) of the steel sheet due to the thermal history during soft-nitriding, the microstructure of steel sheet is preferably set to be a complex-phase microstructure that includes ferrite as a main phase and pearlite as a second phase. With the present invention, it is preferred that a ferrite fraction in the steel sheet microstructure be 80% or more to 95% or less and a pearlite fraction in the steel sheet microstructure be 5% or more to 20% or less. The steel sheet of the present invention is ideal to be a complex-phase microstructure consisting of ferrite and pearlite. However, even if another phase (microstructure) is inevitably generated, it is acceptable as long as the fraction is 1% or less in total.

The following describes an embodiment of a method for manufacturing the steel sheet of the present invention. The present invention heats a steel slab with the above-described chemical composition and performs hot rolling including rough rolling and finish rolling. After completing the finish rolling, the steel sheet is cooled and coiled, thus producing a hot-rolled steel sheet. In this respect, setting a heating temperature of the slab to 1100° C. or more to 1300° C. or less, a finishing temperature to an $Ar_3$ transformation point or more to ($Ar_3$ transformation point+100° C.) or less, an average cooling rate for cooling to 30° C./s or more, and a coiling temperature to 500° C. or more to 600° C. or less are preferred.

In the present invention, the method for smelting the steel is not specifically limited and can employ a known smelting method using a converter, an electric furnace, or the like. After the smelting, in consideration of a problem of segregation and the like, a steel slab (slab) is preferred to be obtained by a continuous casting method. However, the steel slab may be obtained by a known casting method of an ingot-making-blooming method, a thin slab continuous casting method, and the like. Further, as necessary, various preliminary treatment of molten iron, secondary refining, surface trimming of the steel slab, or the like may be performed.

Heating temperature of steel slab: 1100° C. or more to 1300° C. or less

The steel slab obtained as described above is subjected to rough rolling and finish rolling. In the present invention, V is ideally fully dissolved again in the steel slab before the rough rolling. If the heating temperature of the steel slab is less than 1100° C., the V carbonitride is difficult to be sufficiently decomposed to dissolve V again, possibly failing to develop the desired effect obtained by containing V. Ensuring the required finishing temperature is also difficult. On the other hand, if the heating temperature of the steel slab exceeds 1300° C., energy required for heating the steel slab is increased, which is disadvantageous in a viewpoint of cost. Accordingly, the heating temperature of the steel slab before the rough rolling is set to be 1100° C. or more to 1300° C. or less, preferably, 1150° C. or more to 1250° C. or less.

When heating the steel slab before rough rolling, the steel slab after casting may be cooled to a room temperature and then be heated, or the steel slab after casting and during cooling may be additionally heated or heat of the steel slab may be retained. Alternatively, in the case where the steel slab after casting holds a sufficient temperature and V is sufficiently dissolved in the steel, the steel slab may be directly rolled without heating. Note that rough rolling conditions need not to be specifically limited.

Finishing temperature: $Ar_3$ transformation point or more to ($Ar_3$ transformation point+100° C.) or less In the case where the finishing temperature at the finish rolling is less than the $Ar_3$ transformation point, a ferrite microstructure elongated in a rolling direction and an unrecrystallized ferrite microstructure are formed. This deteriorates the formability of the steel sheet. Additionally, in-plane anisotropy of mechanical properties of the steel sheet becomes strong, uniform shaping process becomes difficult. On the other hand, if the finishing temperature exceeds ($Ar_3$ transformation point+100° C.), the surface appearance quality of the steel sheet tends to worsen. Accordingly, the finishing temperature is set to be $Ar_3$ transformation point or more to ($Ar_3$ transformation point+100° C.) or less. The finishing temperature means a steel sheet temperature at a final path exit-side in the finish rolling.

To ensure the finishing temperature, the steel sheet during rolling may be additionally heated using a heating apparatus such as a sheet bar heater, an edge heater. The $Ar_3$ transformation point of steel may be obtained by measuring thermal shrinkage in a cooling process from an austenite temperature range and creating a thermal shrinkage curve. Alternatively, the $Ar_3$ transformation point may also be obtained by approximation from a content of an alloying element.

Average cooling rate: 30° C./s or more

Ensuring appropriate average cooling rate is important to ensure the solute V in the steel sheet. In embodiments of the present invention, after completing the finish rolling, cooling is immediately (within 1 s) started at the average cooling rate from the finishing temperature to the coiling temperature being 30° C./s or more. If this average cooling rate is less than 30° C./s, carbonitride of V is precipitated in the cooling process, possibly causing absent of the desired amount of solute V in the steel sheet. Additionally, the crystal grains may become excessively coarse, possibly deteriorating the strength and ductility of the steel sheet. Accordingly, the average cooling rate is set to be 30° C./s or more, preferably, 40° C./s or more.

The upper limit of the average cooling rate is not especially specified. However, to avoid a shape defect of the steel sheet caused by strong water cooling, the average cooling rate is preferably set at 100° C./s or less. After the steel sheet is cooled until reaching the coiling temperature, forced cooling by pouring water or the like is not especially required, and the steel sheet be left to be cooled in the air until coiling.

Coiling temperature: 500° C. or more to 600° C. or less

Ensuring appropriate coiling temperature is important to ensure the solute V in the steel sheet and also to form the steel sheet into a desired microstructure. If the coiling temperature is less than 500° C., the low-temperature transformation phase is generated and the steel sheet hardens, deteriorating the formability. Additionally, the deterioration of the strength of the internal portion of sheet thickness (non-nitrided portion) of the steel sheet by the thermal history of soft-nitriding is inevitable. On the other hand, if the coiling temperature exceeds 600° C., a large amount of V carbonitride is precipitated after the coiling. Accordingly, the desired amount of solute V possibly fails to remain in the steel sheet. Therefore, the coiling temperature is set to be 500° C. or more to 600° C. or less, preferably, 520° C. or more to 580° C. or less.

An oxide scale is removed from the hot-rolled steel sheet obtained as described above by pickling, shot peening, or the like, and then the hot-rolled steel sheet is used as a steel sheet for soft-nitriding. Even if temper rolling targeted for shape correction and/or adjustment of surface roughness is performed, the effects of the present invention will not be damaged. The steel sheet for soft-nitriding of the present invention is applicable to any of gas soft-nitriding and salt bath soft nitriding.

EXAMPLE

Steels containing chemical compositions listed in Table 1 were smelted. Then, ingot casting and rolling of ingots were performed to produce steel slabs. These steel slabs were heated, and then rough-rolled, finish-rolled, cooled immediately after the completion of the finish-rolling, and coiled to produce hot-rolled steel sheets with sheet thickness of 3.2 mm. The heating temperature of the steel slab, and the finishing temperature, the average cooling rate from the finishing temperature to the coiling temperature, and the coiling temperature of the above-described steel sheets were as listed in Table 2.

TABLE 1

| | Chemical composition (mass %) | | | | | | | | | | |
|---|---|---|---|---|---|---|---|---|---|---|---|
| Steel | C | Si | Mn | P | S | Al | Cr | V | N | Nb | Remarks |
| A | 0.05 | 0.20 | 1.4 | 0.02 | 0.007 | 0.02 | 1.5 | 0.10 | 0.003 | — | Example of present invention |
| B | 0.06 | 0.03 | 1.5 | 0.02 | 0.005 | 0.04 | 1.0 | 0.25 | 0.002 | — | Example of present invention |
| C | 0.06 | 0.03 | 1.5 | 0.02 | 0.005 | 0.04 | 1.0 | 0.20 | 0.002 | 0.010 | Example of present invention |
| D | 0.06 | 0.03 | 1.5 | 0.02 | 0.005 | 0.04 | 1.0 | 0.02 | 0.002 | — | Comparative example |
| E | 0.06 | 0.03 | 1.5 | 0.02 | 0.005 | 0.04 | 1.0 | 0.35 | 0.002 | — | Comparative example |
| F | 0.08 | 0.05 | 1.0 | 0.03 | 0.005 | 0.05 | 0.8 | 0.15 | 0.001 | — | Example of present invention |
| G | 0.08 | 0.05 | 1.0 | 0.03 | 0.005 | 0.05 | 0.8 | 0.05 | 0.001 | 0.020 | Example of present invention |
| H | 0.08 | 0.06 | 0.5 | 0.04 | 0.008 | 0.05 | 1.0 | 0.20 | 0.001 | — | Comparative example |
| I | 0.10 | 0.10 | 0.7 | 0.05 | 0.004 | 0.03 | 1.2 | 0.20 | 0.003 | — | Example of present invention |
| J | 0.10 | 0.10 | 0.7 | 0.05 | 0.004 | 0.06 | 0.4 | 0.20 | 0.003 | — | Comparative example |
| K | 0.15 | 0.10 | 0.7 | 0.05 | 0.004 | 0.03 | 1.2 | 0.20 | 0.003 | — | Comparative example |

TABLE 2

| | | Ar3 | Manufacturing condition | | | | |
|---|---|---|---|---|---|---|---|
| Steel sheet No. | Steel | transformation point (° C.)*1 | Heating temperature (° C.) | Finishing temperature (° C.) | Average cooling rate (° C./s) | Coiling temperature (° C./s) | Remarks |
| 1 | A | 772 | 1200 | 820 | 40 | 600 | Example of present invention |
| 2 | A | 772 | 1200 | 740 | 30 | 550 | Comparative example |
| 3 | B | 787 | 1150 | 840 | 50 | 500 | Example of present invention |
| 4 | B | 787 | 1150 | 840 | 25 | 600 | Comparative example |
| 5 | B | 787 | 1150 | 840 | 30 | 650 | Comparative example |
| 6 | C | 781 | 1250 | 860 | 45 | 550 | Example of present invention |
| 7 | D | 763 | 1150 | 840 | 50 | 500 | Comparative example |
| 8 | E | 797 | 1150 | 840 | 30 | 600 | Comparative example |
| 9 | F | 798 | 1250 | 840 | 40 | 550 | Example of present invention |
| 10 | F | 798 | 1250 | 840 | 60 | 450 | Comparative example |
| 11 | G | 787 | 1250 | 860 | 40 | 520 | Example of present invention |
| 12 | H | 823 | 1200 | 860 | 40 | 580 | Comparative example |
| 13 | I | 809 | 1200 | 860 | 30 | 580 | Example of present invention |
| 14 | J | 830 | 1200 | 860 | 30 | 600 | Comparative example |
| 15 | K | 794 | 1200 | 840 | 30 | 600 | Comparative example |
| 16 | B | 787 | 1000 | 780 | 40 | 500 | Comparative example |

TABLE 2-continued

| Steel sheet No. | Steel | Ar3 transformation point (° C.)*1 | Manufacturing condition: Heating temperature (° C.) | Finishing temperature (° C.) | Average cooling rate (° C./s) | Coiling temperature (° C./s) | Remarks |
|---|---|---|---|---|---|---|---|
| 17 | B | 787 | 1250 | 920 | 50 | 600 | Comparative example |
| 18 | F | 798 | 1100 | 840 | 60 | 500 | Example of present invention |
| 19 | G | 787 | 1150 | 820 | 30 | 580 | Example of present invention |

*1The $Ar_3$ transformation point (° C.) was obtained by approximation from a content of an alloying element by the following formula.

$Ar_3$ (° C.) = 835 − 203 $\sqrt{C}$ + 44.7Si − 30Mn + 700P + 400Al − 11Cr + 104V Note that C, Si, Mn, P, Al, Cr, and V are respective contents of the alloying elements (by mass %).

The hot-rolled steel sheet obtained as described above was descaled by pickling, and then a temper rolling at an elongation rate of 0.5% was performed. Then, specimens were extracted from the steel sheets after the temper rolling and were provided for the following evaluations.

(i) Amount of Solute V

The amount of solute V was obtained as follows. Specimens were extracted from the one-quarter position in the sheet width direction of the steel sheet after the temper rolling. Then, a V amount in the precipitate in the steel obtained by performing galvanostatic electrolysis on the specimens in electrolyte is subtracted from the V content.

(ii) Microstructure Observation

At a one-quarter position in the sheet width direction of the steel sheet after the temper rolling, specimens of a cross-section of the sheet thickness parallel to the rolling direction were extracted, polished to obtain mirror surface, and etched with nital. Then, the one-quarter positions in the sheet thickness direction were photographed at appropriate magnifications between 500 to 3000 powers with an optical microscope or a scanning electron microscope. Using the obtained microstructure photographs, a ferrite area ratio and an area ratio of pearlite to the entire microstructure, and kinds of other microstructures and their area ratios to the entire microstructure were obtained by image analysis to set respective fractions. The obtained results were listed in Table 3.

TABLE 3

| Steel sheet No. | Steel | Microstructure: Ferrite (%)*2 | Pearlite (%)*3 | Others (%)*4 | Ratio of solute V: Solute V/V*5 | Amount of solute V (mass %) | V content (mass %) | Remarks |
|---|---|---|---|---|---|---|---|---|
| 1 | A | 92 | 8 | 0 | 0.60 | 0.06 | 0.10 | Example of present invention |
| 2 | A | 93 | 7 | 0 | 0.40 | 0.04 | 0.10 | Comparative example |
| 3 | B | 90 | 10 | 0 | 0.72 | 0.18 | 0.25 | Example of present invention |
| 4 | B | 89 | 11 | 0 | 0.48 | 0.12 | 0.25 | Comparative example |
| 5 | B | 86 | 14 | 0 | 0.44 | 0.11 | 0.25 | Comparative example |
| 6 | C | 91 | 9 | 0 | 0.65 | 0.13 | 0.20 | Example of present invention |
| 7 | D | 90 | 10 | 0 | 0.50 | 0.01 | 0.02 | Comparative example |
| 8 | E | 91 | 9 | 0 | 0.46 | 0.16 | 0.35 | Comparative example |
| 9 | F | 86 | 14 | 0 | 0.73 | 0.11 | 0.15 | Example of present invention |
| 10 | F | 72 | 0 | 28 (B) | 0.93 | 0.14 | 0.15 | Comparative example |
| 11 | G | 88 | 12 | 0 | 0.80 | 0.04 | 0.05 | Example of present invention |
| 12 | H | 85 | 15 | 0 | 0.55 | 0.11 | 0.20 | Comparative example |
| 13 | I | 82 | 18 | 0 | 0.55 | 0.11 | 0.20 | Example of present invention |
| 14 | J | 83 | 17 | 0 | 0.60 | 0.12 | 0.20 | Comparative example |
| 15 | K | 78 | 22 | 0 | 0.45 | 0.09 | 0.20 | Comparative example |
| 16 | B | 92 | 8 | 0 | 0.32 | 0.08 | 0.25 | Comparative example |
| 17 | B | 90 | 10 | 0 | 0.48 | 0.12 | 0.25 | Comparative example |
| 18 | F | 90 | 9 | 1 (B) | 0.67 | 0.10 | 0.15 | Example of present invention |
| 19 | G | 86 | 14 | 0 | 0.60 | 0.03 | 0.05 | Example of present invention |

*2Ferrite fraction (%)

*3Pearlite fraction (%)

*4Fractions of microstructures other than ferrite and pearlite B denotes bainite.

*5Ratio of an amount of solute V among V content (Amount of solute V/V content)

(iii) Tensile Test

At the one-quarter position in the sheet width direction of the steel sheet after temper rolling, No. 5 specimens specified by JIS Z 2201 (1998) (gage length L: 50 mm) were extracted such that the tensile test direction became the rolling direction. Subsequently, a tensile test in compliance with the specification of JIS Z 2241 (1998) was conducted on the specimens and a tensile strength (TS) and total elongation (El) were measured. Thus, strength-elongation balance (TS×El) was obtained. In this example, a steel sheet whose tensile strength (TS) was 440 MPa or more and strength-elongation balance (TS×El) was 17 GPa·% or more was evaluated as a steel sheet with high strength and good formability.

(iv) Cross Section Hardness Test

Specimens were extracted from the steel sheets after the temper rolling and Vickers hardness (HVc) at the one-half position in the sheet thickness direction was measured by the method in compliant to JIS Z 2244 (2009).

<Measurement Method>

Test force: 0.98 N

Measurement location: five locations (v) Soft-Nitriding Test

Small pieces were extracted from the steel sheets after the temper rolling to perform gas soft-nitriding under conditions described below.

Soft-nitriding atmosphere: gas where ammonia gas is mixed with the same amount of endothermic converted gas Treatment temperature: 580° C.

Treating time: 2.5 hours

The small pieces were held at the treatment temperature (580° C.) for the treating time (2.5 hours) and then were oil quenched (oil temperature: 70° C.) . Then, the small pieces after oil quenching were provided for the following evaluation.

In compliant to JIS G 0563 (1993), Vickers hardness (HV0.1) at a 0.1 mm-depth position from a sheet surface of the small pieces after the oil quenching was measured. A practical depth of nitrided case compliant to the specification of JIS G 0562 (1993) was also measured. This example evaluated the small piece whose Vickers hardness (HV0.1) was 500 or more and the practical depth of nitrided case was 0.40 mm or more as the small piece with good surface hardening characteristics. By the method similar to (iv), Vickers hardness (HVc') at the one-half position in the sheet thickness direction (non-nitrided portion) was measured representing the hardness of the internal portion of sheet thickness (non-nitrided portion) of the steel sheet. From the Vickers hardness (HVc), which is hardness at the one-half sheet thickness position before the soft-nitriding obtained at (iv), and Vickers hardness (HVc'), which is hardness at the one-half sheet thickness position after the soft-nitriding, a percentage of rise of the Vickers hardness at the sheet-thickness center portion by the soft-nitriding: (HVc'−HVc)/HVc×100 (%) was obtained. In this example, the small piece whose percentage of rise of the Vickers hardness was more than 5.0% was evaluated as having good fatigue resistance property (Good) after soft-nitriding and the small piece other than that was evaluated as Poor. The obtained results were listed in Table 4.

TABLE 4

| | Mechanical properties | | | Surface hardening characteristics | | Fatigue resistance property | | | | |
|---|---|---|---|---|---|---|---|---|---|---|
| Steel sheet No. | Tensile strength TS (MPa) | Elongation El (%) | TS × El (GPa · %) | Hardness of nitrided layer (HV0.1)*6 | Practical depth of nitrided case (mm) | Hardness before nitriding (HVc)*7 | Hardness after nitriding (HVc')*8 | Percentage of rise of hardness (%)*9 | Evaluation*10 | Remarks |
| 1 | 444 | 40 | 17.8 | 744 | 0.55 | 137 | 145 | 5.9 | Good | Example of present invention |
| 2 | 476 | 35 | 16.7 | 763 | 0.50 | 147 | 155 | 5.2 | Good | Comparative example |
| 3 | 501 | 35 | 17.5 | 685 | 0.60 | 155 | 167 | 7.5 | Good | Example of present invention |
| 4 | 463 | 38 | 17.6 | 683 | 0.55 | 143 | 150 | 4.8 | Poor | Comparative example |
| 5 | 451 | 39 | 17.6 | 688 | 0.55 | 139 | 146 | 4.9 | Poor | Comparative example |
| 6 | 526 | 33 | 17.4 | 666 | 0.50 | 163 | 175 | 7.1 | Good | Example of present invention |
| 7 | 489 | 36 | 17.6 | 634 | 0.30 | 151 | 143 | −5.6 | Poor | Comparative example |
| 8 | 495 | 35 | 17.3 | 726 | 0.60 | 153 | 161 | 4.9 | Poor | Comparative example |
| 9 | 462 | 38 | 17.6 | 587 | 0.45 | 143 | 152 | 6.5 | Good | Example of present invention |
| 10 | 517 | 30 | 15.5 | 592 | 0.50 | 161 | 152 | −5.3 | Poor | Comparative example |
| 11 | 532 | 32 | 17.0 | 522 | 0.40 | 165 | 174 | 5.2 | Good | Example of present invention |
| 12 | 436 | 42 | 18.3 | 672 | 0.55 | 134 | 142 | 5.7 | Good | Comparative example |
| 13 | 462 | 38 | 17.6 | 716 | 0.55 | 143 | 151 | 5.8 | Good | Example of present invention |
| 14 | 451 | 39 | 17.6 | 492 | 0.35 | 139 | 147 | 5.6 | Good | Comparative example |
| 15 | 496 | 33 | 16.4 | 716 | 0.50 | 154 | 160 | 4.1 | Poor | Comparative example |
| 16 | 518 | 30 | 15.5 | 691 | 0.55 | 161 | 164 | 1.9 | Poor | Comparative example |
| 17 | 457 | 37 | 16.9 | 680 | 0.50 | 141 | 147 | 4.3 | Poor | Comparative example |
| 18 | 487 | 36 | 17.5 | 592 | 0.45 | 151 | 159 | 5.3 | Good | Example of present invention |
| 19 | 520 | 33 | 17.2 | 526 | 0.40 | 162 | 171 | 5.6 | Good | Example of present invention |

*6Vickers hardness at a 0.1 mm-depth positon from a steel sheet surface after soft-nitriding

*7Vickers hardness at a one-half sheet thickness position of a steel sheet before soft-nitriding

*8Vickers hardness at a one-half sheet thickness position of a steel sheet after soft-nitriding

*9(HVc' − HVc)/HVc × 100 (%)

*10Percentage of rise of hardness of more than 5.0% was evaluated as Good and 5.0% or less was evaluated as Poor.

As apparent from Table 4, the examples of present invention obtained good results in all of strength, formability, and surface hardening characteristics and fatigue resistance property by soft-nitriding. On the other hand, the comparative examples whose steel composition and microstructure do not satisfy the preferred conditions of the present invention did not obtain sufficient results in some of the above-described characteristics.

The invention claimed is:

1. A steel sheet for soft-nitriding, having:

a chemical composition containing:

C: 0.05% or more to 0.10% or less;

Si: 0.5% or less;

Mn: 0.7% or more to 1.5% or less;

P: 0.05% or less;

S: 0.01% or less;

Al: 0.03% or more to 0.06% or less;

Cr: 0.5% or more to 1.5% or less;

Ti: 0% or more to 0.005% or less;

V: 0.03% or more to 0.30% or less; and

N: 0.003% or less, on a mass percent basis, wherein a ratio of amount of solute V on a mass percent basis to the V content on a mass percent basis is more than 0.50, and balance comprises Fe and incidental impurities, and a complex-phase microstructure containing ferrite and pearlite.

2. The steel sheet for soft-nitriding according to claim 1, wherein the chemical composition further contains Nb of 0.005% or more to 0.025% or less by mass %.

3. A method for manufacturing a steel sheet for soft-nitriding, including:

heating a steel slab;

performing hot rolling that includes rough rolling and finish rolling; and after the finish rolling, cooling and coiling the steel sheet to produce a hot-rolled steel sheet, wherein the steel slab has a chemical composition containing:

C: 0.05% or more to 0.10% or less;

Si: 0.6% or less;

Mn; 0.7% or more to 1.4% or less;

P; 0.05% or less;

S: 0.01% or less;

At: 0.03% or more to 0.06% or less;

Cr 0.5% or more to 1.5% or less;

Ti: 0% or more to 0.005% or less;

V: 0.03% or more to 0.30% or less; and

N: 0.005% or less, on a mass percent basis, wherein balance comprises Fe and incidental impurities, and setting a heating temperature of the hot rolling from 1100° C. or more to 1300° C. or less, setting a finishing temperature of the finish rolling from an $Ar_3$ transformation point or more to ($Ar_3$ transformation point+100° C.) or less, setting an average cooling rate of the cooling to 30° C./s or more, and setting a coiling temperature of the coiling from 500° C. or more to 600° C. or less, such that the steel sheet of claim 1 is formed.

4. The method for manufacturing the steel sheet for soft-nitriding according to claim 3, wherein the chemical composition further contains Nb of 0.005% or more to 0.025% or less by mass %.

* * * * *